US010153595B2

(12) United States Patent
Quero et al.

(10) Patent No.: US 10,153,595 B2
(45) Date of Patent: Dec. 11, 2018

(54) PLUG CONNECTOR PART, SHIELDED PLUG CONNECTOR UNIT AND LOCKING SLEEVE THEREFOR

(71) Applicants: José Quero, Bietigheim-Bissingen (DE); Marcin Moscicki, Löchgau (DE); Hermann Engber, Stuttgart (DE)

(72) Inventors: José Quero, Bietigheim-Bissingen (DE); Marcin Moscicki, Löchgau (DE); Hermann Engber, Stuttgart (DE)

(73) Assignee: LQ MECHATRONIK-SYSTEME GMBH, Freiberg am Neckar (DE)

( * ) Notice: Subject to any disclaimer, the term of this patent is extended or adjusted under 35 U.S.C. 154(b) by 0 days.

(21) Appl. No.: 15/660,268

(22) Filed: Jul. 26, 2017

(65) Prior Publication Data

US 2018/0034212 A1 Feb. 1, 2018

(30) Foreign Application Priority Data

Jul. 28, 2016 (DE) ..... 10 2016 213 952

(51) Int. Cl.
*H01R 13/648* (2006.01)
*H01R 13/6582* (2011.01)
(Continued)

(52) U.S. Cl.
CPC ..... *H01R 13/6582* (2013.01); *H01R 13/521* (2013.01); *H01R 13/562* (2013.01);
(Continued)

(58) Field of Classification Search
CPC ..... H01R 13/6582; H01R 13/51; H01R 13/52
(Continued)

(56) References Cited

U.S. PATENT DOCUMENTS 4,090,759 A * 5/1978 Herrmann, Jr. ..... H01R 13/53 439/279
4,116,521 A * 9/1978 Herrmann, Jr. ..... H01R 13/53 439/274

(Continued)

FOREIGN PATENT DOCUMENTS

DE 44 19 023 A1 12/1995
DE 195 28 678 C1 1/1997

(Continued)

OTHER PUBLICATIONS

Search Report of European Patent Office issued in European Application No. 17 18 1741 with English translation of category of cited documents dated Dec. 14, 2017 (9 pages).

(Continued)

*Primary Examiner* — Abdullah Riyami
*Assistant Examiner* — Nader Alhawamdeh
(74) *Attorney, Agent, or Firm* — Flynn Thiel, P.C.

(57) ABSTRACT

A plug connector part for a shielded plug connector unit, including an insulating body and a plurality of electric plug-in contacts connected to electric cable ends. An electric plug-in contact is configured as a protective conductor contact, and has an electrically conducting shielding shell surrounding the insulating body on the exterior side. The protective conductor contact is arranged centrally in the interior of the insulating body and is surrounded by the other electric plug-in contacts on the exterior side. The protective conductor contact is electrically contacted to the shielding shell by at least one electrically conducting radial web.

12 Claims, 4 Drawing Sheets

(51) Int. Cl.

| | |
|---|---|
| ***H01R 13/52*** | (2006.01) |
| ***H01R 13/56*** | (2006.01) |
| ***H01R 13/625*** | (2006.01) |
| ***H01R 13/652*** | (2006.01) |
| ***H01R 13/6597*** | (2011.01) |
| *H01R 43/20* | (2006.01) |
| *H01R 24/30* | (2011.01) |
| *H01R 107/00* | (2006.01) |

(52) U.S. Cl.
CPC ..... *H01R 13/625* (2013.01); *H01R 13/652* (2013.01); *H01R 13/6597* (2013.01); *H01R 24/30* (2013.01); *H01R 43/20* (2013.01); *H01R 2107/00* (2013.01)

(58) Field of Classification Search
USPC ..... 439/218, 607.01
See application file for complete search history.

(56) References Cited

U.S. PATENT DOCUMENTS

| | | | | |
|---|---|---|---|---|
| 4,723,916 | A * | 2/1988 | Fusselman ..... | H01R 9/031 439/607.14 |
| 5,573,411 | A | 11/1996 | Bartosz et al. | |
| 6,780,068 | B2 * | 8/2004 | Bartholoma ..... | H01R 13/426 439/752 |
| 7,416,448 | B2 | 8/2008 | Gaidosch | |
| 7,537,466 | B2 * | 5/2009 | Bartholoma ..... | H01R 13/652 439/95 |
| 7,824,204 | B2 * | 11/2010 | Fujiwara ..... | H01R 13/5219 439/311 |
| 9,437,970 | B2 * | 9/2016 | Quero Pacheco ... | H01R 13/562 |
| 2006/0205251 | A1 | 9/2006 | Gaidosch | |
| 2012/0127690 | A1 * | 5/2012 | Quero ..... | H01R 9/03 361/825 |
| 2014/0295690 | A1 * | 10/2014 | Quero pacheco .... | H01R 13/562 439/271 |

FOREIGN PATENT DOCUMENTS

| | | | |
|---|---|---|---|
| DE | 200 07 001 | U1 | 8/2000 |
| DE | 103 23 614 | A1 | 8/2004 |
| DE | 20 2005 012 756 | U1 | 12/2005 |
| DE | 10 2012 203 459 | A1 | 5/2013 |
| EP | 1 063 732 | A1 | 12/2000 |

OTHER PUBLICATIONS

Office Action of German Patent Office issued in Application No. 10 2016 213 952.5 dated Mar. 23, 2017 (6 Pages).

* cited by examiner

PLUG CONNECTOR PART, SHIELDED PLUG CONNECTOR UNIT AND LOCKING SLEEVE THEREFOR

The invention relates to a plug connector part for a shielded plug connector unit, comprising an insulating body and a plurality of electric plug-in contacts which are connected to electric cable ends, wherein an electric plug-in contact is configured as a protective conductor contact, and having an electrically conducting shielding shell surrounding the insulating body on the exterior side.

A multi-pole plug connector unit is disclosed in DE 10 2012 203 459 A1. The known plug connector unit includes two mutually complementary plug connector parts. The two plug connector parts each have a monolithic insulating body, wherein respective electric plug-in contacts together with a protective conductor contact are integrated. The two insulating bodies of the two plug connector parts are capable of being plugged into each other axially. The respective electric plug-in contacts are firmly connected to corresponding cable ends of an electric cable. In order to mutually secure the two plug connector parts in the plugged-together condition, a locking sleeve is additionally provided, which is held on one of the two plug connector parts and latchable to an exterior shell of the other plug connector part.

To achieve electromagnetic shielding of electric lines, shielded cables are employed, with the cable ends thereof being interconnected via shielded plug connector parts.

An object of the invention is to provide a plug connector part, a shielded plug connector unit and a locking sleeve of the abovementioned type, which allow simple and reliable electromagnetic shielding.

This object is achieved for the plug connector part in that the protective conductor contact is arranged centrally in the interior of the insulating body and surrounded by the other electric plug-in contacts on the exterior side, and in that the protective conductor contact is electrically contacted to the shielding shell by means of at least one electrically conducting radial web. The central arrangement of the protective conductor contact is advantageous in an electric aspect. The connection of the protective conductor contact via at least one electrically conducting radial web towards the outside to the shielding shell ensures reliable earthing. The solution according to the invention is suitable for multi-pole plug connector units for industrial wiring of machines and equipment. The plug connector part according to the invention is particularly advantageous for application in connection with the shielded plug connector unit for three-phase alternating current systems. The plug connector part and the corresponding plug connector unit are configured for transmission of voltages up to 630 volts and of amperages up to 16 amperes. With particular advantage, the plug connector part according to the invention is employed for plug connector units used for power and signal transmission of machine tools.

In an embodiment of the invention, the at least one radial web is elastically pre-tensioned in the installed operating condition. The electric contacting of the radial web is merely by mechanical contact to the protective conductor contact and the external shielding shell. In order to ensure that said mechanical contacting is maintained permanently, the elastic pre-tensioning of the at least one radial web is provided.

In a further embodiment of the invention, a metallic leaf spring element is provided as the radial web. The metallic leaf spring element, firstly, has sufficient electric conductivity. Secondly, it allows easy elastic pre-tensioning.

In a further embodiment of the invention, a plurality of identically designed leaf spring elements are provided which protrude—distributed over a circumference of the insulating body—in different radial directions from the central protective conductor outwards. Advantageously, three identical leaf spring elements are provided, which protrude radially outwards in a star-shaped pattern from the central protective conductor acting as a central conductor.

In a further embodiment of the invention, each leaf spring element has a pre-tensioning portion curved in a u-shape and on each of its opposite face ends a respective radially outwards or inwards protruding contacting portion. The curved pre-tensioning portion and the contacting portions adjoin each other, as seen across the length of the leaf spring element. The leaf spring element including the pre-tensioning portion and the two contacting portions is embodied in one piece.

In a further embodiment of the invention, the insulating body includes at least one radially extending accommodation pocket in which the leaf spring element is inserted. The insulating body has a monolithic design and is made of an appropriate synthetic material. The at least one radially extending accommodation pocket is integrally molded into the insulating body as early as during production of the insulating body. The number of accommodation pockets provided in the insulating body corresponds to the number of leaf spring elements inserted into the insulating body.

In a further embodiment of the invention, the accommodation pocket has a slotted design and includes an accommodation opening to the outside, which opening is dimensioned such that the leaf spring element with the pre-tensioning portion and the radially inwards projecting contacting portion is insertable radially from the outside, and the accommodation pocket has a contact opening to the protective conductor towards the inside, with the dimensioning thereof matched to the inwards projecting contacting portion. The outside accommodation opening of the accommodation pocket has a width corresponding at least to the width of the pre-tensioning portion curved in a u-shape of the leaf spring element, since the leaf spring element has the greatest width in the region of the pre-tensioning portion. Since the inwards protruding contacting portion projects radially inwards in relation to a corresponding U-leg of the pre-tensioning portion, the contact opening of the accommodation pocket needs to present an essentially smaller width towards the interior, which width is matched merely to the dimensioning of the contacting portion.

For the shielded plug connector unit of the abovementioned type, comprising two mutually complementary plug connector parts, and comprising a locking sleeve to mutually secure the plug connector parts in the plugged-together condition, the object of the invention is solved in that the locking sleeve is made of synthetic material and provided with an electrically conducting exterior layer and with an electrically conducting interior layer. Production of the locking sleeve using synthetic material allows simple and cost-efficient mass production. Coating the locking sleeve with a respective electrically conducting layer on the interior and exterior sides allows the desired shielding and the desired electrically conductive contacting to the respective electrically conductive shielding shell of the two plug connector parts and, as a result, also to the respective protective conductor.

In an embodiment of the plug connector unit, the electrically conducting exterior layer has a greater layer thickness than the electrically conducting interior layer. Owing to the fact that the electrically conducting interior layer has a smaller layer thickness than the electrically conducting exterior layer, a greater elasticity is provided for the functional portions on the inner side of the locking sleeve such that a functionality of corresponding elastic functional portions on the interior shell of the locking sleeve is not or almost not affected. A layer thickness of the exterior layer is preferably in a range of 50 μm to 150 μm, and a layer thickness of the interior layer is in a range of 20 μm to 50 μm. A ratio of outside to inside layer thickness is preferably in the range between 2:1 and 5:1.

In a further embodiment of the invention, both the exterior layer and the interior layer are electrochemical coatings of an outer circumference and an inner circumference, respectively, of the locking sleeve. Corresponding electrochemical coatings are metallic and, consequently, electrically conducting.

In a further embodiment of the invention, the locking sleeve is provided with at least one integrally molded, spring-elastically mobile latching lug on the inner circumference thereof, which lug is coated by an electrically conducting interior layer. The integrally molded, spring-elastically mobile latching lug represents an elastic functional portion of the locking sleeve, as described above.

For the locking sleeve of the abovementioned type, the object of the invention is solved in that the locking sleeve is provided with the features of at least one of the above-described embodiments or configurations. The locking sleeve can be manufactured as a separate component and installed on a corresponding plug connector part of the plug connector unit. Such a locking sleeve can again be disassembled from the respective plug connector part and, accordingly, is exchangeable.

Further advantages and features of the invention will become apparent from the claims and from the description below of a preferred exemplary embodiment of the invention which is illustrated with reference to the drawings.

Figure 1:
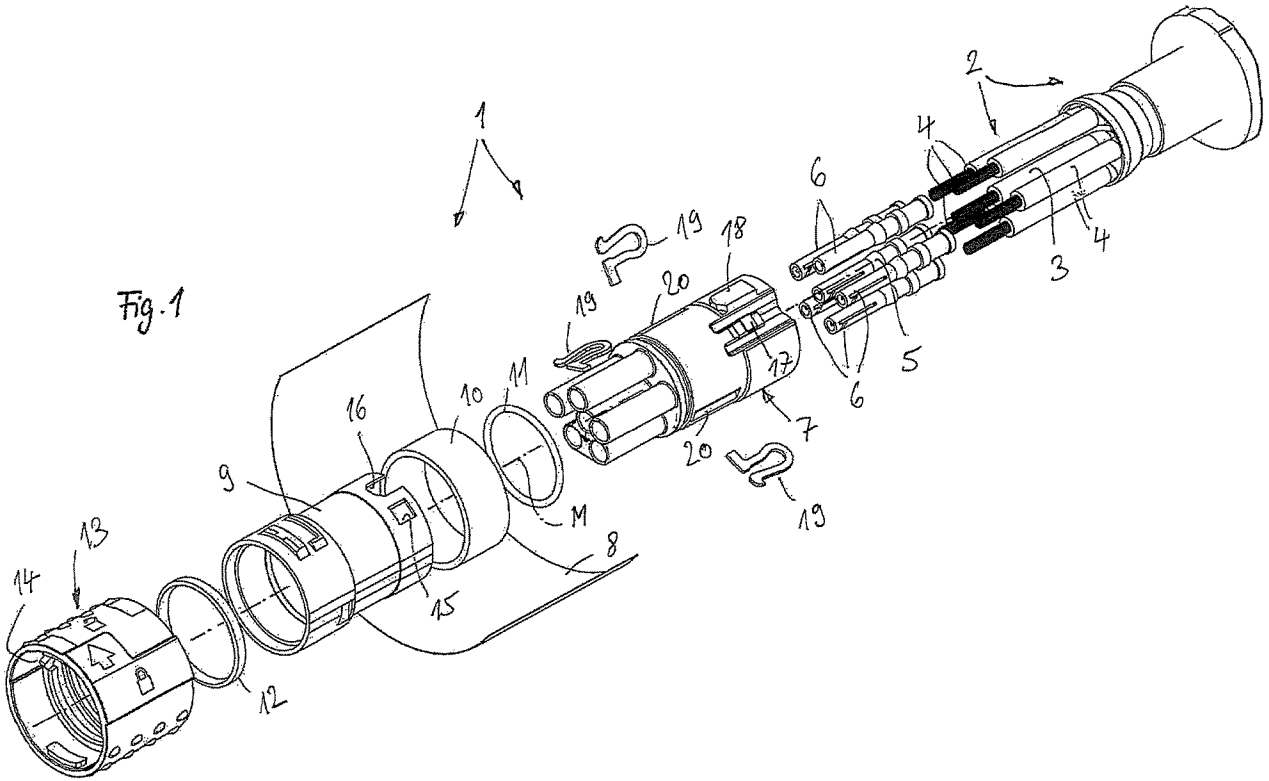
FIG. 1 shows a perspective exploded view of an embodiment of a plug connector part according to the invention.

According to FIGS. 1 to 8, a shielded plug connector unit includes a plug connector part 1, as will be described in more detail below. The plug connector unit additionally includes a complementary plug connector part (not illustrated) which has a functional design identical to that of the plug connector part 1. Merely those functional parts and portions related to the plug-in function of the (not illustrated) plug connector part have a design complementary to that of the corresponding functional parts and portions of the plug connector part 1, in order to allow secure axial plugging-in of the two plug connector parts and secure electrical contacting of electric plug-in contacts which likewise—like the other functional parts and portions of the complementary plug connector part—have a complementary design such that a female plug connector part 1 on the one hand and a (not illustrated) male connector part on the other hand are provided. Thus, the explanations given below apply similarly also to the (not illustrated) complementary plug connector part.

Each plug connector part 1 is connected to a respective cable end 2 of an electric cable which includes a plurality of cable strands 3, 4. One cable strand is a protective conductor 3. Additionally, a total of five further cable strands 4 are provided. The cable strands serve for signal transmission and for power transmission. If no signal transmission is required, the cable can also include merely four conductors and then be provided with four cable strands. The cable strands 4 of the cable end 2 are connected to electric plug-in contacts 6, wherein the cable strands 4 preferably are connected to the electric plug-in contacts 6 by crimping. The protective conductor 3, also referred to as PE conductor, ends in a centrally arranged protective conductor contact 5, wherein an accordingly stripped cable strand of the protective conductor 3 is crimped with the protective conductor contact 5 in the same manner as the cable strands 4 with the electric plug-in contacts 6. The protective conductor contact 5 has a design identical to that of the plug-in contacts 6, however, is arranged centrally between the plug-in contacts 6 which surround the central protective conductor contact 5 radially on the exterior side—as seen in the circumferential direction.

The protective conductor contact 5 is positioned at least largely coaxial to a central longitudinal axis M of the plug connector part 1. The terms "radial" and "axial" are in each case related to the central longitudinal axis M. Moreover, a shrunk-on hose piece 10 is provided on a support sleeve 9, which is embodied in an adhesive shrink hose and used as a bonding agent. Instead of an adhesive shrink hose, application of an adhesive agent can be provided as well.

Both the five electric plug-in contacts 6 and the central protective conductor contact 5 are axially inserted in corresponding accommodations of a monolithic insulating body 7 which is made of a synthetic material. The electric plug-in contacts 6 and also the protective conductor contact 5 are formed by corresponding metal sleeves.

Figure 2:
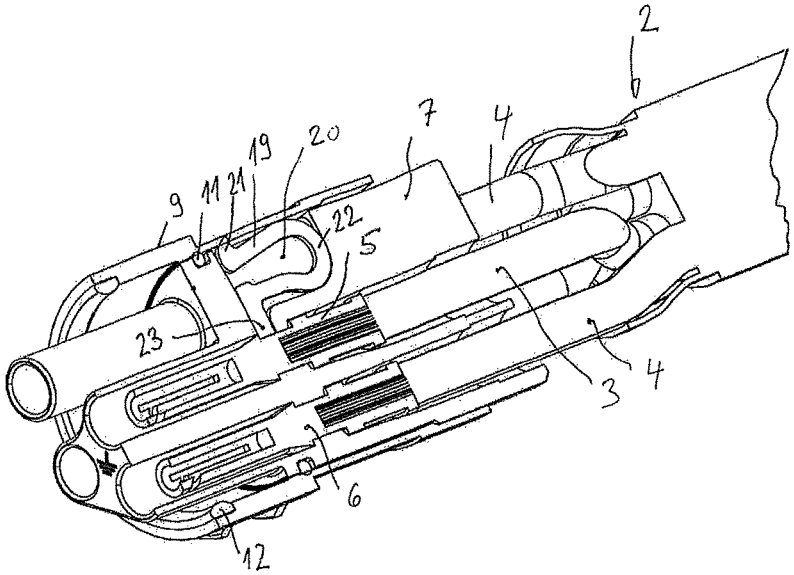
FIG. 2 shows a longitudinal section of the plug connector part according to FIG. 1.

A support sleeve 9 is axially latched onto the monolithic insulating body 7. Between the support sleeve 9 and an exterior shell of the insulating body 7 is disposed a sealing ring 11 (FIGS. 1 and 2).

The support sleeve 9 has an electrochemical coating, in order to form part of an electrically conducting shielding shell of the plug connector part 1. Both the support sleeve 9 and the cable end 2 are additionally associated with an electrically conducting shielding film 8 to sheath the cable end 2 and the support sleeve 9 and, thus, the insulating body 7 at least partially. The electrically conducting shielding film 8 constitutes another part of the electrically conducting shielding shell. The support sleeve 9 is made of synthetic material and exhibits an electrically conducting surface both in the region of the inner circumference thereof and in the region of the outer circumference thereof, owing to the electrochemical coating. A layer thickness of the electrochemical coating of the support sleeve 9 has the same dimensions both on the inner and the outer side.

A locking sleeve 13 is movably held on the support sleeve 9, which locking sleeve is made of a synthetic material and serves to lock the plug connector part 1 and the complementary plug connector part in the plugged-together condition, and thereby to axially secure the plug connector part 1 in relation to the complementary plug connector part. The locking sleeve 13 is made of synthetic material and owing to an electrochemical coating, which will be explained in more detail below, exhibits an electrically conducting surface both in the region of the inner circumference thereof and in the region of the outer circumference thereof. For fixing the support sleeve 9 on the insulating body 7, mutually complementary plug and latching profiles 15 to 18 are provided on the support sleeve 9 on the one hand and on the exterior shell of the insulating body 7 on the other hand, which are apparent with reference to FIG. 1.

Figure 3:
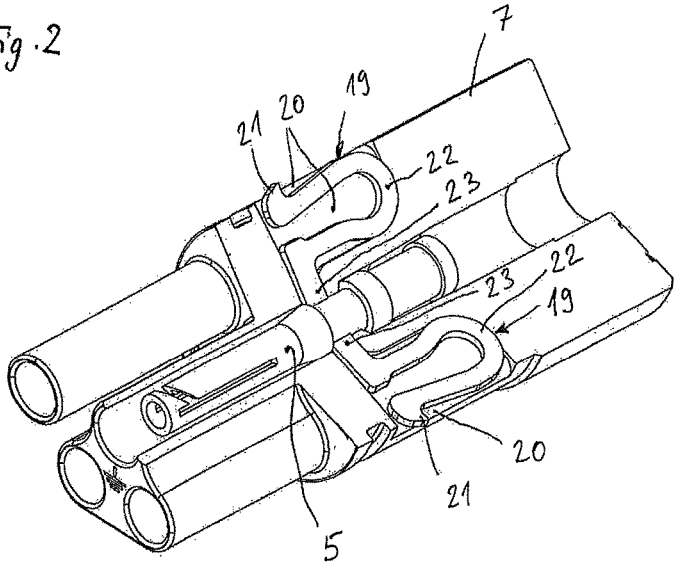
FIG. 3 shows a broken longitudinal section of an insulating body of the plug connector part according to FIGS. 1 and 2 with inserted leaf spring elements and a centrally arranged protective conductor.
Figure 4:
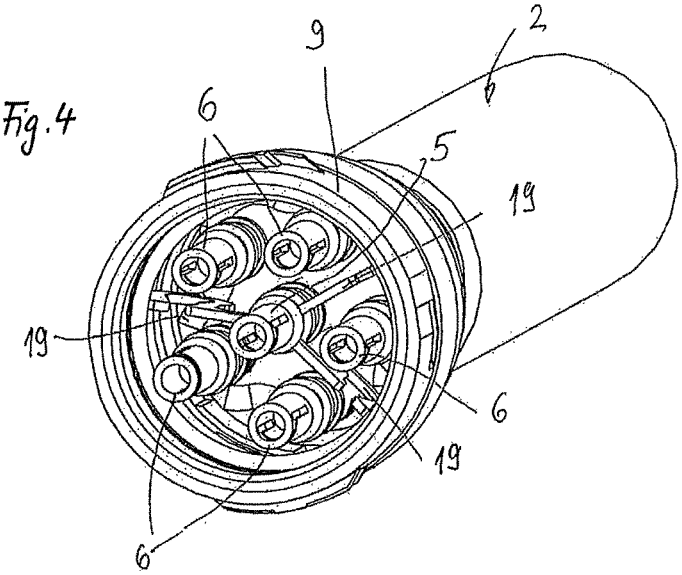
FIG. 4 shows a perspective view of a detail of the plug connector part according to FIGS. 1 to 3 illustrating the arrangement of the three leaf spring elements between the different electric plug-in contacts.
Figure 5:
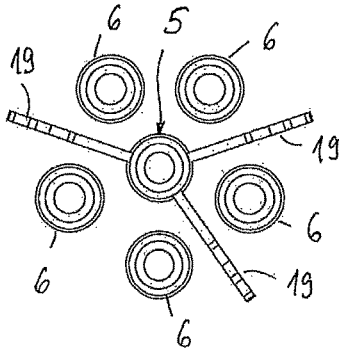
FIG. 5 shows the star-shaped pattern of the leaf spring elements relative to the central protective conductor and the other electric plug-in contacts surrounding the protective conductor on the outer side.
Figure 6:
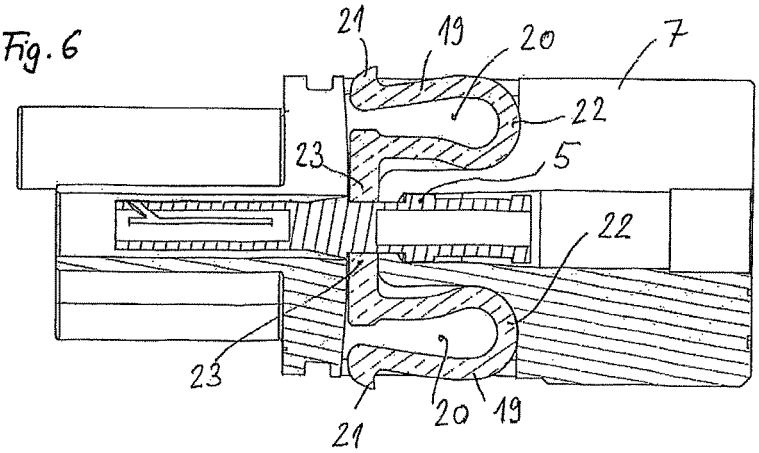
FIG. 6 shows a broken longitudinal section of the insulating body of the plug connector part according to FIGS. 1 to 5.

In order to connect the protective conductor 3 to the electrically conducting shielding shell, the insulating body 7 includes a total of three slotted accommodation pockets 20 distributed over the circumference thereof, which extend in different radial planes relative to the central longitudinal axis M, and which are oriented in different directions in relation to each other. With reference to FIGS. 2 and 3, and also with reference to FIG. 6, it is clearly apparent that each of the three accommodation pockets 20 has a great length, as seen radially from the outside, axially in relation to the central longitudinal axis M, which length decreases stepwise radially inwards towards the protective conductor contact 5. A width of each slotted accommodation pocket 20 is identical over an entire axial and radial extent of the accommodation pocket 20. All of the three accommodation pockets 20 have an identical design and serve for accommodation of a respective leaf spring element 19, as clearly apparent with reference to FIGS. 1 to 6. Each leaf spring element 19 is a one-piece, electrically conducting component, in particular a metallic component. Each leaf spring element 19 is preferably made of beryllium copper. Each leaf spring element 19 has a radially inner-sided contacting portion 23 which extends relative to the central longitudinal axis M radially inwards in the manner of a web. Said contacting portion 23 is adjoined by a u-shaped pre-tensioning portion 22 which has an approximately semi-circular curvature in the plane of the accommodation pocket 20. The u-shaped pre-tensioning portion 22 has a radially inner-sided U-leg and a radially outer-sided U-leg, wherein the radially inner-sided U-leg is integrally adjoined to the inner contacting portion 23. The radially outer U-leg ends in a radially outer contacting portion 21, which is configured in the manner of a hooked nose. The two contacting portions 21 and 23 and also the pre-tensioning portion 22 are oriented in a common plane. The pre-tensioning portion 22 allows an elastically resilient mobility of the two U-legs, so that the leaf spring element 19 can be pre-tensioned by corresponding radial force application from the interior and from the exterior.

With reference to FIGS. 2 to 6, it is apparent that the radial inner contacting portions 23 of the leaf spring elements 19 are in abutment on an exterior shell of the protective conductor contact 5. Once the support sleeve 9 is axially pushed onto the insulating body 7 and latched on, the radially outer contacting portions 21 with their hooked noses additionally press from an interior side against the electrochemical coating of the inner circumference of the support sleeve 9 such that an electrically conducting connection is produced between the exterior shell of the protective conductor contact 5, the leaf spring elements 19 and the support sleeve 9. The oblique edge contour of the hooked noses of the contacting portions 21 in the pushing-on direction of the support sleeve 9 facilitates sliding of the support sleeve 9 along the hooked noses. With reference to FIGS. 2 and 3, it is apparent that the leaf spring elements 19 can be inserted into the accommodation pockets 20 of the insulating body 7 from the exterior in a simple manner. The accommodation pockets 20 are integrally molded together with the production of the monolithic insulating body 7.

The radially outer contacting portions 21 in the shape of hooked noses protrude to a minor extent radially beyond an exterior shell of the insulating body 7, in the unloaded rest condition of the leaf spring elements 19. Once the support sleeve 9 is axially pushed onto the outer circumference of the insulating body 7 and latched on, the outer contacting portions 21 shaped as hooked noses are pressed radially inwards, whereby the leaf spring elements 19 become pre-tensioned. As a result, the inner contacting portions 23 are necessarily pressed radially inwards against the outer circumference of the protective conductor contact 5, whereby a secure and permanent mechanical abutment between the protective conductor contact 5 and the electrically conducting support sleeve 9 is created.

Figure 7:
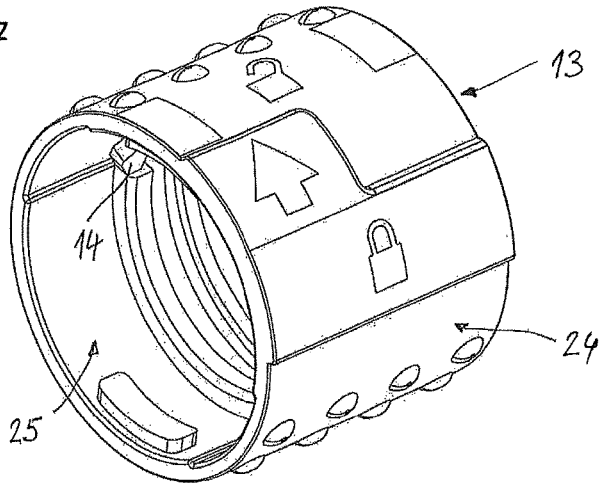
FIG. 7 shows an enlarged perspective view of a locking sleeve for the plug connector part according to FIG. 1.
Figure 8:
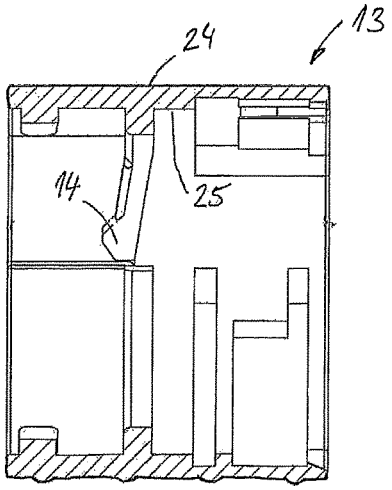
FIG. 8 shows a longitudinal section through the locking sleeve according to FIG. 7.

In order to ensure that a desired shielding of the plug connector unit in the plugged-together condition of the complementary plug connector parts 1 is maintained, the plug connector unit is additionally associated with the locking sleeve 13 which is more clearly apparent with reference to FIGS. 7 and 8. The locking sleeve 13 in the exemplary embodiment as illustrated is axially latched on the support sleeve 9 and held for limited rotation in relation to the support sleeve 9.

Moreover, the support sleeve 9 includes a sealing ring 12 in the region of the plug accommodation, which ring provides sealing with the complementary insulating body of the other plug connector part.

The locking sleeve 13 is provided with two partially cut-free and, thus, elastically mobile latching lugs 14 on the inner circumference thereof, which lugs are integrally molded to the inner circumference of the locking sleeve 13. With reference to the drawings, merely one latching lug 14 is visible. Merely the visible latching lug 14 will be described below. The explanations apply accordingly also to the other latching lug. The latching lug 14 is produced from an appropriate synthetic material together with the production of the locking sleeve 13. The locking sleeve 13 is coated with an electrically conducting exterior layer 24 and with an electrically conducting interior layer 25, as indicated in FIG. 8, wherein the electrically conducting interior layer 25 is also applied on the latching lug 14. Both the interior layer 25 and the exterior layer 24 were produced by electrochemical coating of the locking sleeve 13 composed of synthetic material. In that context, the interior layer 25 has a lower layer thickness than the exterior layer 24. The interior layer 25 having the lower layer thickness is provided to maintain sufficient elastic mobility of the latching lug 14. Since both the interior layer 25 and the exterior layer 24 are metallic, an excessive layer thickness of the interior layer 25 would cause a reduction or even failure of the elastic mobility of the latching lug 14. Owing to the reduced layer thickness of the interior layer 25 as compared to the layer thickness of the exterior layer 24, the desired elastic mobility of the latching lug 14 is ensured. However, the reduced layer thickness of the interior layer 25 is sufficient to achieve the desired electric conductivity of the locking sleeve 13, in order to continue shielding of the plug connector unit even beyond the locking sleeve in a bridge between the two plug connector parts.

In the exemplary embodiment as illustrated, the interior layer 25 has a uniform layer thickness over the entire inner circumference of the locking sleeve 13. In one (not illustrated) exemplary embodiment of the invention, it is provided as an alternative that the locking sleeve 13 has a reduced layer thickness merely in the region of the inner-sided accordingly elastically mobile functional portion, however, in the other regions has the same layer thickness as the exterior layer.

The invention claimed is:

1. A plug connector part for a shielded plug connector unit, comprising:

an insulating body;

a plurality of electric plug-in contacts which are connected to electric cable ends, wherein at least one of the electric plug-in contacts is configured as a protective conductor contact; and an electrically conducting shielding shell surrounding the insulating body on the exterior side;

wherein the protective conductor contact is arranged centrally in the interior of the insulating body and surrounded by the other electric plug-in contacts on the exterior side; and wherein the protective conductor contact is electrically contacted to the shielding shell by at least one electrically conducting radial web.

2. The plug connector part according to claim 1, wherein the at least one radial web is elastically pre-tensioned in the installed operating condition.

3. The plug connector part according to claim 1, wherein the at least one electrically conducting radial web comprises a metallic leaf spring element.

4. The plug connector part according to claim 1, wherein the at least one electrically conducting radial web comprises a plurality of identically designed leaf spring elements which protrude—distributed over a circumference of the insulating body—in different radial directions from the central protective conductor outwards.

5. The plug connector part according to claim 4, wherein each leaf spring element has a pre-tensioning portion curved in a u-shape and, on each of its opposite face ends, a respective radially outwardly or inwardly protruding contacting portion.

6. The plug connector part according to claim 5, wherein the insulating body includes at least one radially extending accommodation pocket in which each leaf spring element is inserted.

7. The plug connector part according to claim 6, wherein the at least one radially extending accommodation pocket has a slotted design and includes an accommodation opening to the outside, which opening is dimensioned such that the leaf spring element with the pre-tensioning portion and a radially inwardly projecting contacting portion is insert-able radially from the outside, and in that the at least one radially extending accommodation pocket has a contact opening to the protective conductor contact towards the inside, with the dimensioning thereof matched to the inwardly projecting contacting portion.

8. A shielded plug connector unit, comprising:

two mutually complementary plug connector parts; each plug connector part comprising a shielded plug connector unit; each shielded plug connector unit comprising an insulating body, a plurality of electric plug-in contacts which are connected to electric cable ends, with at least one of the electric plug-in contacts being configured as a protective conductor contact, and an electrically conducting shielding shell surrounding the insulating body on the exterior side; wherein the protective conductor contact is arranged centrally in the interior of the insulating body and surrounded by the other electric plug-in contacts on the exterior side; and wherein the protective conductor contact is electrically contacted to the shielding shell by at least one electrically conducting radial web; and the unit further comprising a locking sleeve to mutually secure the plug connector parts in the plugged-together condition, wherein the locking sleeve is made of synthetic material and provided with an electrically conducting exterior layer and with an electrically conducting interior layer.

9. The shielded plug connector unit according to claim 8, wherein the electrically conducting exterior layer has a greater layer thickness than the electrically conducting interior layer.

10. The shielded plug connector unit according to claim 8, wherein both the exterior layer and the interior layer are electrochemical coatings of an outer circumference and an inner circumference, respectively, of the locking sleeve.

11. The shielded plug connector unit according to claim 8, wherein the locking sleeve is provided with at least one integrally molded, spring-elastically mobile latching lug on the inner circumference thereof, which lug is coated by the electrically conducting interior layer.

12. A locking sleeve for the shielded plug connector unit according to claim 8.

* * * * *